US006286289B1

(12) United States Patent
Powell et al.

(10) Patent No.: US 6,286,289 B1
(45) Date of Patent: Sep. 11, 2001

(54) MULTIPLE FACE SHEET ISOGRID STRUCTURES

(76) Inventors: John W. Powell, 7638 Danks Dr., Evergreen, CO (US) 80439; Stanley D Hisel, P.O. Box 621861, Littleton, CO (US) 80162-1861; Matthew J Dvornak, 5661 S. Parfet St., Littleton, CO (US) 80439

( * ) Notice: Subject to any disclaimer, the term of this patent is extended or adjusted under 35 U.S.C. 154(b) by 0 days.

(21) Appl. No.: 09/456,465

(22) Filed: Dec. 8, 1999

(51) Int. Cl.[7] ..... E04C 2/34

(52) U.S. Cl. ..... 52/790.1; 52/793.11; 52/799.11; 52/799.14; 52/799.13; 52/799.12

(58) Field of Search ..... 52/661, 660, 790.1, 52/793.11, 799.1, 799.11, 799.12, 799.13, 799.14, 262, 264

(56) References Cited

U.S. PATENT DOCUMENTS

| | | | | |
|---|---|---|---|---|
| 1,576,559 | * | 3/1926 | Swift | 52/262 |
| 2,193,994 | * | 3/1940 | Weaver | 52/262 |
| 3,940,891 | | 3/1976 | Slysh . | |
| 4,040,333 | | 8/1977 | Slysh . | |
| 4,055,924 | * | 11/1977 | Beaver, Jr. | 52/262 |
| 4,173,103 | * | 11/1979 | Sargis | 52/799.13 |
| 5,471,367 | * | 11/1995 | Krumweide et al. | 361/719 |
| 5,485,723 | | 1/1996 | McCoy et al. . | |
| 5,487,930 | * | 1/1996 | Lockshaw et al. | 52/793.11 |
| 5,787,654 | | 8/1998 | Drost . | |

* cited by examiner

*Primary Examiner*—Beth A. Stephan
*Assistant Examiner*—Dennis L. Dorsey

(57) ABSTRACT

An isogrid structure formed from multiple face sheets (14) and multiple stringers (16). Each face sheet (14) and each stringer (16) being an individual component. Each stringer (16) having two or more joints for attachment to the face sheets (14). The face sheets (14) formed from flat sheet material and include a pattern of openings for attachment of the joints on the stringers (16). The geometry of the openings matching the geometry of the joints on the stringers (16). The assembled unit is formed by inserting each joint on a stringer (16) through its corresponding opening in a face sheet (14) and then bonding the joint to the face sheet (14).

1 Claim, 5 Drawing Sheets

MULTIPLE FACE SHEET ISOGRID STRUCTURES

CROSS-REFERENCE TO RELATED APPLICATIONS

Not Applicable

BACKGROUND

Field of the Invention

This invention relates to fabricated isogrid structures, specifically to an improved design and method of manufacturing isogrid structures.

BACKGROUND

Description of the Prior Art

The concept of an isogrid structure originated from work sponsored by the U.S. military in the early 1970's. The focus of the work was to develop light weight structures with isotropic mechanical properties for aerospace and military hardware applications. This work resulted in the current concept for design and manufacture of isogrid structures. The current concept used in design and manufacture of isogrid structures is as follows.

An isogrid panel is a plate called a face sheet with a triangular array of integral stiffening ribs called stringers. The stringers have a stiffener called a flange on the side opposite the face sheet. In cross section the stringer has the appearance of an I Beam. The stringer forms the I beam web. The flanges are formed by the face sheet and the stiffener flange. The face sheet is continuous between all the stringers.

For a an isogrid structure to have isotropic mechanical properties the stringers must be arranged in equilateral triangles. However, other stringer structures are often used such as squares and rectangles. These other structures can perform quite well when design requirements do not need true isotropic mechanical properties.

Isogrid structures have been previously manufactured by two methods. The first method is by machining the structure from a thick plate of material. For aerospace applications this is done by taking a large plate of material and milling the isogrid panel from the plate using high speed milling machines that have been developed specifically for this purpose. The quality of product is excellent using this method but it has two major disadvantages. First, the material yield is very low. For expensive materials this greatly adds to the cost of the part. Second, milling isogrid panels is expensive due to the cost of custom built milling machines and the long machine time required to remove the bulk of material from the plate. Both of these disadvantages result in expensive parts fabricated by this method. This has limited the use of this method of manufacturing.

The second method of manufacturing isogrid structures is by casting. If the flange on the stringer is removed and draft angle is added to the sides of the stringer to allow mold extraction, then an isogrid structure can be cast using a permanent mold casting method. This design for an isogrid reduces the stiffness and the isotropic mechanical properties. However, for some applications this is acceptable. The use of casting to produce isogrid structures can result in a low cost mass produced product. It does have disadvantages. The first is that product design changes require the manufacture of a new mold. This is an expensive and lengthy process. It reduces the ability for this manufacturing process to be used for one of a kind and small quantity product. A second disadvantage of the casting process for manufacture of isogrid structures is the loss of mechanical properties due to the removal of the stinger flange.

The use of isogrid structures manufactured by the above processes are found in patent records. These are U.S. Pat. No. 4,040,333 ISOGRID SHELL GUN MOUNT filed Oct. 18, 1976; U.S. Pat. No. 5,485,723 VARIABLE THICKNESS ISOGRID CASE filed Apr. 29, 1994: and U.S. Pat. No. 5,787,654 ISOGRID TILE filed Sep. 21, 1995. These patents show the usefulness of light weight high strength isogrid structures. The disadvantages of the current design and fabrication methods has limited their application. These disadvantages are itemized below.

(a) The material yield for machined isogrid structures is low. For expensive materials this greatly increases the cost of the finished product.

(b) Machining of isogrid structures is an inherently expensive process.

(c) Cast isogrid structures do not attain isotropic mechanical properties.

(d) A cast isogrid structure requires a new mold each time the product design is changed. Mold making is an expensive process. This limits the use of this method to medium and high production quantities.

(e) Both methods of manufacture cannot achieve very thin sections in the face sheet, the ribs, and the flanges. This puts a lower limit on the weight of the structure that can be designed using these methods.

SUMMARY

In accordance with the present invention an isogrid structure is comprised of multiple face sheets with multiple stringers between the face sheets. Tabs on the edges of the stringers fit through mating slots in the face sheets. The tabs on the stringers are joined to the face sheets to form a ridged isogrid structure.

OBJECT AND ADVANTAGES

Accordingly, several objects and advantages of the present invention are:

a) to provide an isogrid structure that is very light weight and strong with true isotropic mechanical properties;

b) to provide an isogrid structure with reduced weight by using material cut outs in the face sheets and stringers;

c) to provide an isogrid structure that is manufactured from components that are cut out of flat sheet greatly reducing material costs and waste;

d) to provide an isogrid structure that can be inexpensive and quickly manufactured in quantities as low as one to mass production quantities;

e) to provide an isogrid structure with face sheets and stringers that can have a thinner wall thickness than can be achieved with existing methods of manufacture;

f) to provide an isogrid structure design that lends itself to design and fabrication using computer aided design (CAD) and computer aided manufacture (CAM):

g) to provide an isogrid structure design that can use high speed inexpensive cutting methods such as computer controlled water jet or plasma arc cutting instead of high speed milling; and h) to provide an isogrid structure design that can use computer controlled joining processes such as computer controlled welding or gluing to attach the stringers to the face sheets.

Further objects and advantages will become apparent from a consideration of the ensuing description and drawings.

DRAWING FIGURES

In the drawings, closely related figures have the same number but different alphabetic suffixes.

Figure 1:
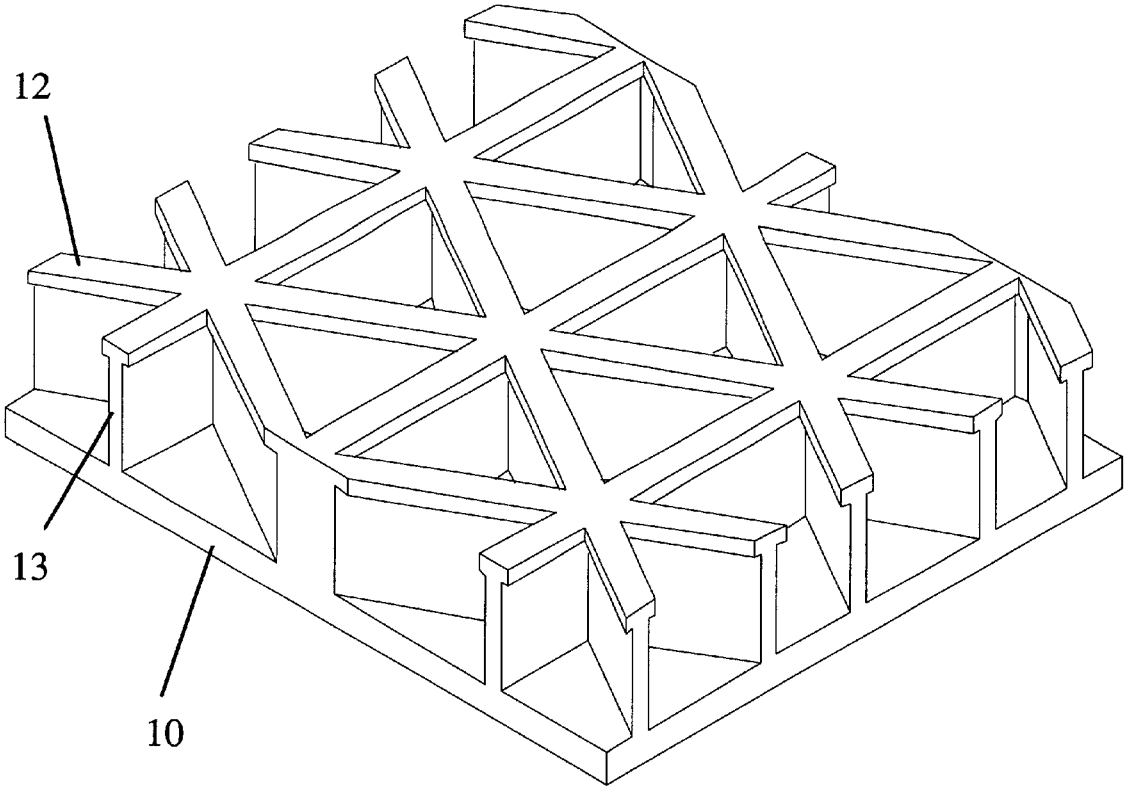
Fig 1 Prior Art
FIG. 1 shows prior art of an isogrid structure that is milled from a solid plate of metal. The isogrid structure shown has a face sheet with a stringer and a flange all formed by milling from a plate of metal that was as least as thick as the final isogrid structure.

| Reference Numerals in Drawings |
|---|
| 10 milled face sheet |
| 12 milled flange |
| 13 milled stringer |
| 14 face sheet |
| 16 stringers |
| 18 second face sheet |
| 20 stringer tabs |
| 22 stringer slots |
| 24 stringer cut outs |
| 26 face sheet cut outs |
| 28 welded joints |
| 30 side walls |
| 32 stringer tubes |

DESCRIPTION

FIG. 1—Prior Art

FIG. 1 shows a prior art isogrid structure. The isogrid structure is comprised of a milled face sheet 10 attached to a milled stringer 13. To milled stringer 13 is attached a milled flange 12. The structure is machined from a continuous solid without joints or separate components.

Figure 2A:
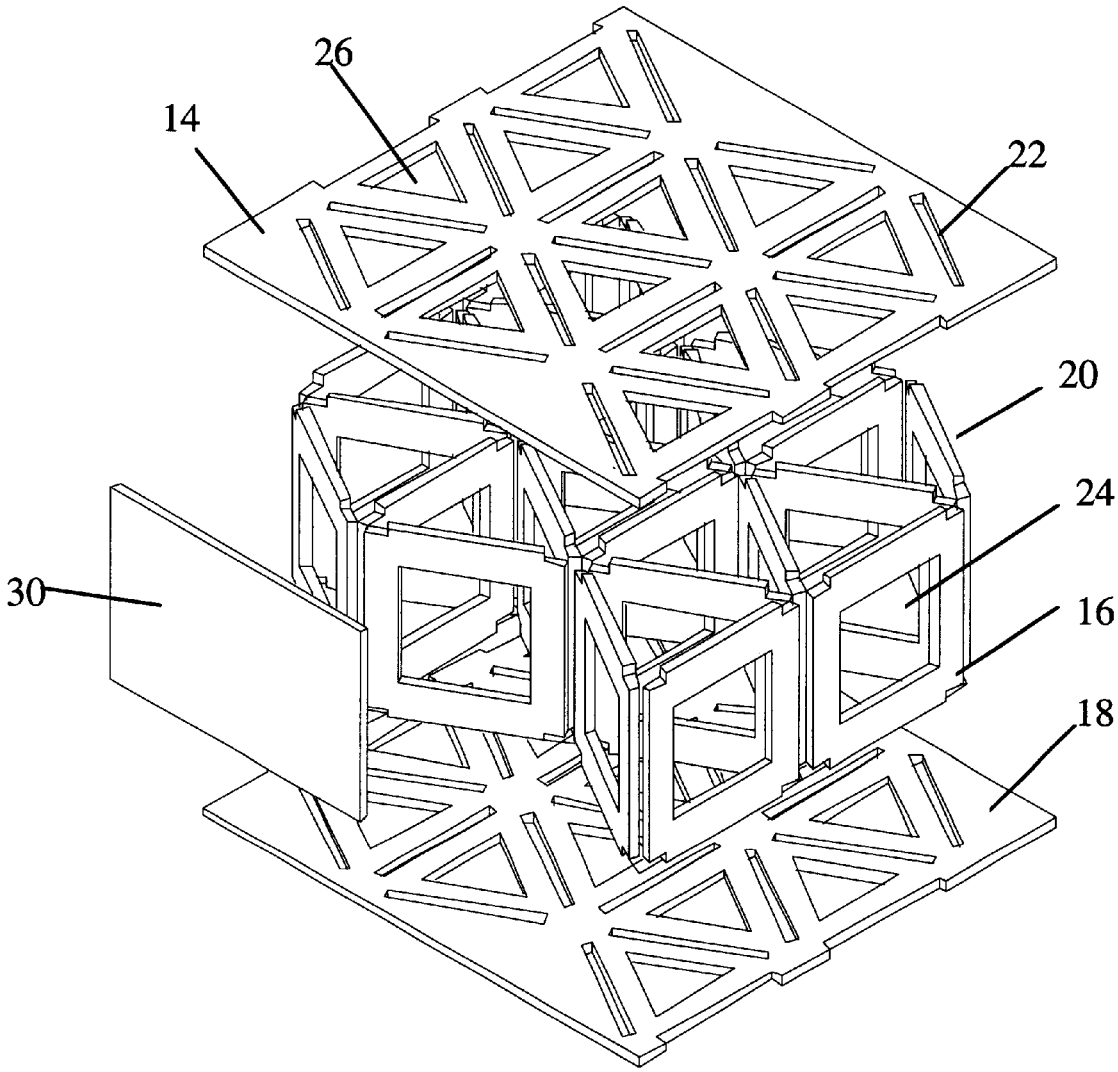
FIG. 2A shows a preferred multiple face sheet isogrid structure with the components in exploded view. This view shows how flat plate components are assembled to form the isogrid structure.
Figure 2B:
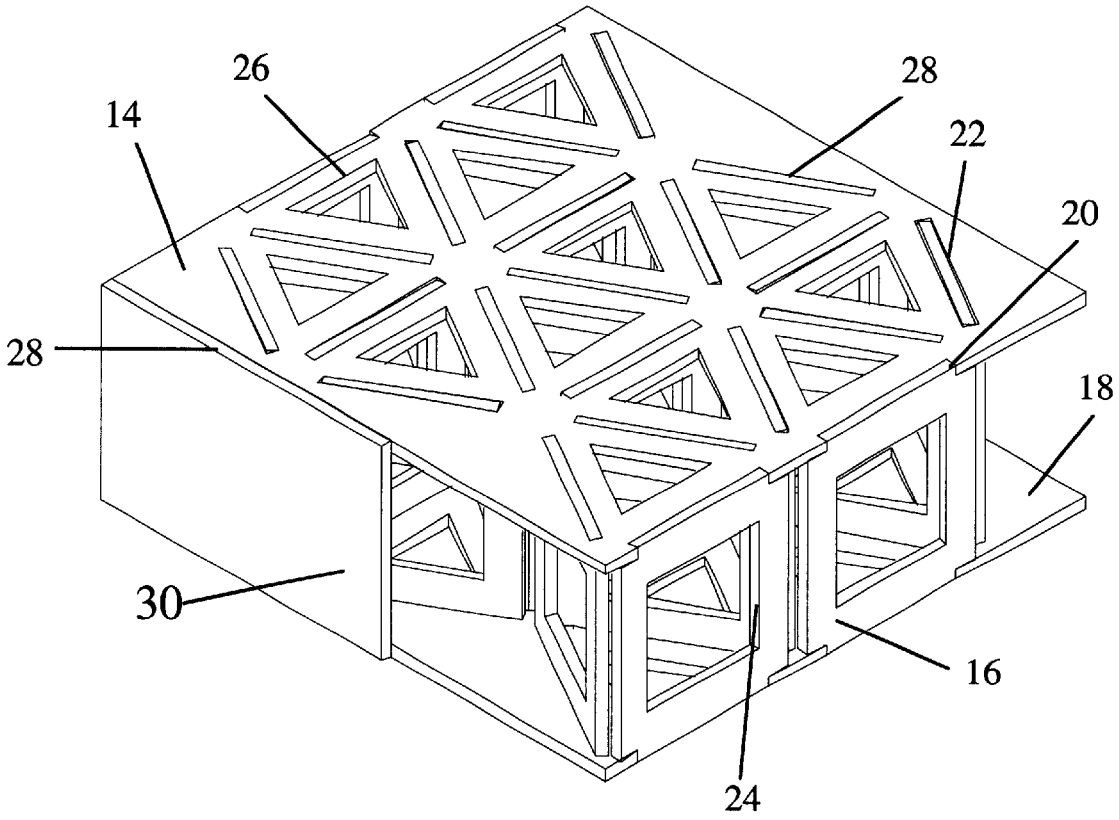
FIG. 2B shows the completed preferred multiple face sheet isogrid structure. The assembly has been joined by weld fabrication at the assembly joints.

FIGS. 2A and 2B—Preferred Embodiment

A preferred embodiment of the multiple face sheet isogrid structure is shown in exploded view in FIG. 2A. This view shows how individual components of the isogrid structure are formed from flat sheet stock and how they fit together to form the assembly. A face sheet 14 has holes cut in it to form stringer slots 22 and to form weight reduction holes called face sheet cut outs 26. Stringers 16 have integral stringer tabs 20 and weight reduction holes called stringer cut outs 24. A second face sheet 18 forms the second face of the isogrid structure. The sides of the isogrid structure are formed from side walls 30.

The preferred embodiment of the multiple face sheet isogrid structure is shown in FIG. 2A is shown in assembled form in FIG. 2B. Stringers 16 are sandwiched between face sheet 14 and second face sheet 18. The side walls 30 are assembled to the edges of the face sheets 14 and 18. Stringer tabs 20 fit through stringer slots 22 in face sheet 14 and second face sheet 18. This holds the assembly at a proper spacing for the welding operation. The face sheet material around stinger slots 22 are then welded to stinger tabs 20 and the side walls 30 are welded to the face sheets 14 and 18 to form the welded joints 28 and to complete the assembly.

Figure 3:
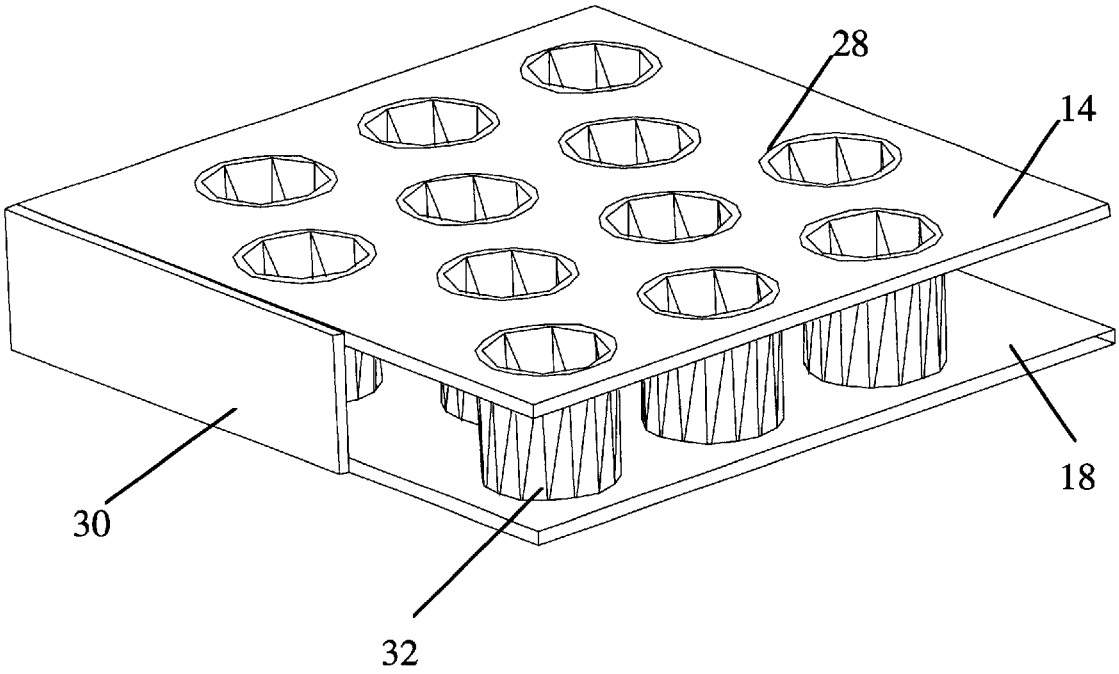
FIG. 3 shows a variation of a multiple face sheet isogrid structure that uses tubing to replace flat plate stringers in its design and fabrication.

FIG. 3—Alternative Embodiment

There are various possibilities for the geometry's of the stringers that comprise the proposed multiple face sheet isogrid structure. One such geometry is shown in FIG. 3. In this isogrid structure the flat plate type stringers 16 have been replaced with tube stringers 32. The weight reduction holes on the isogrid structure have been eliminated. Holes are cut through face sheet 14 and second face sheet 18 to match the outside diameter of tube stringers 32. After components are assembled side walls 30 and the tube stringers 32 are welded to the face sheet 14 and the second face sheet 18 to form welded joints 28.

Figure 4:
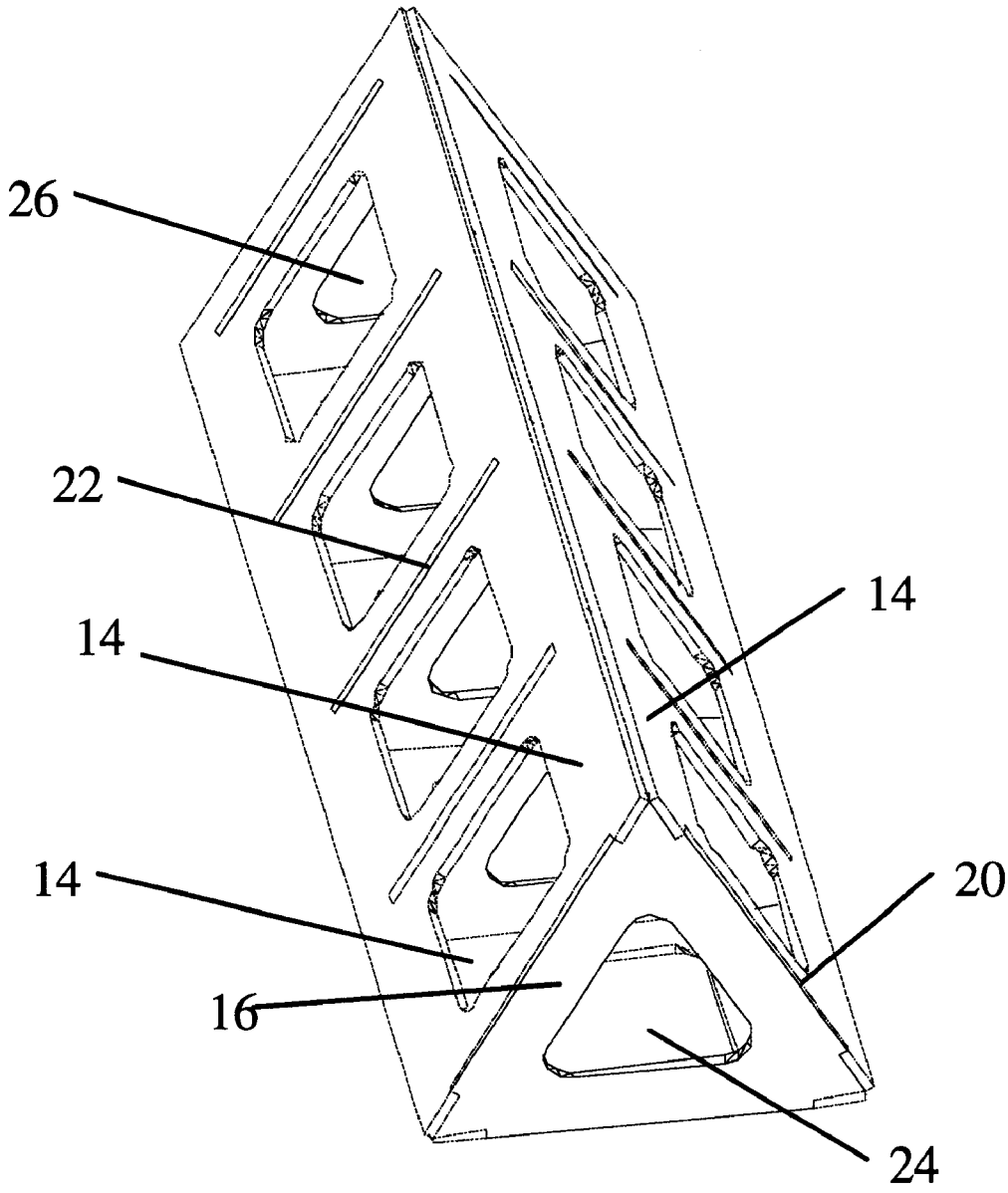
FIG. 4 shows a variation of a multiple face sheet isogrid structure that has three non parallel face sheets that form an equilateral triangular prism.

FIG. 4—Alternative Embodiment of Non Parallel Face Sheets

An alternative embodiment for non parallel face sheet isogrid structure is shown in FIG. 4. In this structure three face sheets 14 form an equilateral triangular prism. The stringers 16 are cut to match the inside of the triangular prism. The stringer tabs 20 fit through the stringer slots 22 in the face sheets 14 and are joined to form the assembly.

Advantages

From the description above, a number of advantages for the multiple face sheet isogrid structure become evident:

a) These isogrid structures allow components with uniform properties to be fabricated. Since the structure is comprised of multiple identical face sheets the properties are uniform from one side to the other. The uniform properties do not depend upon the which geometry is chosen for the stringers. The selection of the stringer geometry and the spacing of the stringers effects the total stiffness and strength achieved in the isogrid structure but not its uniform mechanical properties.

b) The components of the isogrid structure are cut from sheet material using computer controlled plasma arc cutting or water jet cutting processes. This greatly reduces material waste over the prior art method of milling a structure from plate stock that is as thick as the final structure fabricated.

c) Components of the isogrid structure can be robotically assembled and welded. This reduces the total labor needed to fabricate the multiple face sheet isogrid structure. The total time required to fabricate these structures is much less than the milling method currently used. This results in substantial cost savings.

d) Where very light weight high strength structures are required the multiple face sheet isogrid structure can be used. Section thickness can be pared down to the minimum and weight reduction holes can be incorporated. This can be done with very little increase in the cost of fabricating the structure.

e) The fabrication of one of a kind structures is possible with multiple face sheet isogrid structures with low cost and fast turn around. This is possible because of the advent of computer aided design (CAD) and computer aided manufacture (CAM). Using CADCAM the structure can be designed in CAD software. The design can then be used to program of the cutting and welding processes. This removes the need for operator intervention in these processes. The time and labor savings make it possible to economically produce one of a kind product.

f) With CADCAM high volume low cost production of structures is possible. The computer control of the cutting, assembly, and welding processes makes it economical to produce large volume product. The low waste of material also reduces the cost of large volume product.

g) Non metallic materials can be used to fabricate multiple face sheet isogrid structures. Computer controlled water jet cutting allows cutting of ceramics and plastics as easily as cutting metal. The joints on the isogrid structure are then bonded with adhesives or in the case of ceramics the may be bonded by firing with a low melting ceramic material or welded with enriched metal edge technology.

Operation—FIGS. 2A, 2B, 3

The isogrid structure provides a three dimensional structural component in the same manner as a solid plate or bar of material. A solid material is treated as having uniform mechanical properties in the length, width, and thickness directions. This assumption is used by a design engineer when calculating load bearing capabilities of the material in a structural design.

The isogrid structure allows direct replacement of a solid material with a structure that has uniform mechanical properties in both the length and width direction. However, the isogrid structure has a much greater strength to weight ratio than a solid material. This allows the design engineer to achieve higher strength to weight ratios in design applications that require this such as aircraft frames.

The bending strength of a parallel face sheet isogrid structural plate is determined by two factors. The first factor is the thickness of the face sheet 14, the second face sheet 18, and the stringers 16. By increasing the thickness of these sections the isogrid structural sheet can be made stronger. The second factor is the spacing between the face sheets 14 and 18. By increasing this spacing the isogrid structural plate can be made stronger. This is accomplished by increasing the height of the stringers 16. By adjusting these two design specifications the strength of the isogrid structure can be tailored for the application.

Uniform mechanical properties of an isogrid structure are achieved with the preferred embodiment design shown if FIG. 2B. Here the stringers are arrayed in equilateral triangular design. This design produces uniform mechanical properties in any direction parallel to the face sheet 14. Using other stringer designs such as the alternate design shown in FIG. 3 with tube stringers 32 do not produce as uniform of mechanical properties in all directions parallel to the face sheet 14. However, the non-uniformity is small and for many applications this is acceptable.

Conclusions, Ramifications, and Scope

Accordingly, the reader will see that the isogrid structure of this invention can be used to create light weight, high strength structures. These structures are created by cutting components from flat sheet material, assembling the components, and welding the stringer tabs to the face sheet stringer slots. These structures have excellent uniform properties. They are low cost to fabricate even in one of a kind quantities. The design and fabrication processes used are readily automated with the use of computer controlled cutting, assembly, and welding equipment. The mechanical properties can be changed to meet the intended application. Furthermore, the multiple face sheet isogrid structure has the additional advantages in that it allows the design and fabrication of thinner material sections than can be achieved with conventional milling methods or casting methods;

material waste is low compared to machining isogrid structures from solid plate;

uniform mechanical properties are achieved which cannot be achieved with cast isogrid structures.

Although the description above contains many specificity's, these should not be construed as limiting the scope of the invention but merely providing illustrations of some of the presently preferred embodiments of this invention. For example, the stringer geometric pattern may use squares or hexagon arrays instead of triangular arrays.

Thus the scope of the invention should be determined by the appended claims and their legal equivalents, rather than by the examples given.

We claim:

1. A fabricated structure for use in load bearing applications, comprising:

a) a plurality of parallel face sheets of rigid material with weight reducing holes in said parallel face sheets, b) a plurality of stringers constructed from flat rigid material with weight reducing holes in said stringers, c) each said stringer having joints for attachment to said face sheets, d) an equalaterial triangular pattern of openings in each said face sheets, e) the geometry of said openings formed to match the geometry of said joints, f) said joints of said stringers aligned to said openings in said face sheets so that said joints fit into said openings in said face sheets and said stringers form an equalaterial triangular array between said face sheets, g) said stringers joined to said face sheets at said joints, whereby a light weight and strong structure is made that is suitable for use in loadbearing applications.

* * * * *